US007614781B2

(12) United States Patent
Esveld et al.

(10) Patent No.: US 7,614,781 B2
(45) Date of Patent: Nov. 10, 2009

(54) APPARATUS AND METHOD FOR MIXING COMPONENTS

(75) Inventors: Erik Esveld, Wageningen (NL); Remco Hamoen, Wageningen (NL); Hans Hoogland, Vlaardingen (NL)

(73) Assignee: CONOPCO, Inc., Edgewater, NJ (US)

( * ) Notice: Subject to any disclaimer, the term of this patent is extended or adjusted under 35 U.S.C. 154(b) by 761 days.

(21) Appl. No.: 10/535,593

(22) PCT Filed: Nov. 3, 2003

(86) PCT No.: PCT/EP03/12232

§ 371 (c)(1),
(2), (4) Date: Nov. 21, 2005

(87) PCT Pub. No.: WO2004/045754

PCT Pub. Date: Jun. 3, 2004

(65) Prior Publication Data

US 2006/0140052 A1 Jun. 29, 2006

(30) Foreign Application Priority Data

Nov. 20, 2002 (EP) ..... 02079843

(51) Int. Cl.
*B01F 15/00* (2006.01)

(52) U.S. Cl. ..... 366/275

(58) Field of Classification Search ..... 366/275, 366/219, 220

See application file for complete search history.

(56) References Cited

U.S. PATENT DOCUMENTS 2,406,403 A * 8/1946 Rogers ..... 366/97
3,391,047 A * 7/1968 Kopp ..... 206/219
3,512,332 A 5/1970 Klein
3,567,074 A 3/1971 Brown
3,588,054 A * 6/1971 Ljungerg et al. ..... 366/275
3,656,716 A * 4/1972 Ljungerg et al. ..... 366/275
3,659,825 A 5/1972 Reiter
3,681,485 A * 8/1972 Lieberman ..... 366/186
3,744,625 A 7/1973 Chin
4,550,653 A * 11/1985 Hedenberg ..... 99/348

(Continued)

FOREIGN PATENT DOCUMENTS

DE 35 33 166 3/1987

(Continued)

OTHER PUBLICATIONS

Int'l. Search Report No. PCT/EP 2003/12232—dated Mar. 3, 2004—5 pages.

(Continued)

*Primary Examiner*—Tony G Soohoo
(74) *Attorney, Agent, or Firm*—Michael P. Aronson

(57) ABSTRACT

In an apparatus for mixing components in a mixing chamber, those parts of the mixing chamber which will come into contact with the components are defined by a foil material which can be renewed between two successive mixing/processing operations. The mixing chamber may be defined between two co-operating mould parts. The mixing/processing chamber also may be defined by the foil material itself. In a method for mixing components in a mixing chamber such a foil material is renewed between two successive mixing operations. Further there is provided a pre-shaped elongate web of foil material for use in an apparatus.

6 Claims, 4 Drawing Sheets

U.S. PATENT DOCUMENTS

| | | | |
|---|---|---|---|
| 4,557,377 | A | 12/1985 | Maloney |
| 4,711,582 | A | 12/1987 | Kennedy |
| 4,787,511 | A | 11/1988 | McIver |
| 4,951,843 | A | 8/1990 | Paetow |
| 4,997,083 | A | 3/1991 | Loretti et al. |
| 5,207,320 | A | 5/1993 | Allen |
| 5,207,509 | A | 5/1993 | Herbert |
| 5,238,303 | A | 8/1993 | Dixon |
| 5,353,927 | A | 10/1994 | Stupar et al. |
| 5,431,496 | A | 7/1995 | Balteau et al. |
| 5,497,913 | A | 3/1996 | Baker |
| 5,560,403 | A | 10/1996 | Balteau et al. |
| 5,564,829 | A | 10/1996 | Lafond |
| 5,632,554 | A | 5/1997 | Wang et al. |
| 5,709,467 | A | 1/1998 | Galliano, II |
| 5,954,230 | A | 9/1999 | Blette et al. |
| 6,039,719 | A | 3/2000 | Wieslander et al. |
| 6,071,005 | A | 6/2000 | Ekambaram et al. |
| 6,193,058 | B1 | 2/2001 | Yacko et al. |
| 6,837,610 | B2 * | 1/2005 | Cadogan et al. ..... 366/275 |

FOREIGN PATENT DOCUMENTS

| | | | |
|---|---|---|---|
| EP | 0 695 575 | B1 | 7/1995 |
| EP | 0 713 081 | A1 | 9/1995 |
| EP | 0 891 811 | | 1/1999 |
| WO | 97/43039 | | 11/1997 |
| WO | 97/48606 | | 12/1997 |
| WO | 98/26861 | | 6/1998 |
| WO | 98/26997 | | 6/1998 |
| WO | 00/15328 | | 3/2000 |
| WO | 00/54874 | | 9/2000 |
| WO | 01/70923 | A1 | 9/2001 |

OTHER PUBLICATIONS

WPI Acc No: 1987-087350/198713- Derwent abstract of DE 35 33166, 1 page, copyright 2005.

Derwent patent abstracts of DE 4303973 A1 filed 19930819, 2 pages, printed on Aug 12, 2009.

* cited by examiner

APPARATUS AND METHOD FOR MIXING COMPONENTS

The invention firstly relates to an apparatus for mixing components for the preparation of products, such as for example foodstuffs, cosmetics and pharmaceuticals, comprising a mixing chamber which is provided with an inlet for the components and an outlet for the product, and mixing means for mixing the components after introduction thereof into the mixing chamber.

When, using such an apparatus, a product has to be prepared the respective components are introduced into the mixing chamber through the inlet and the mixing means are activated for mixing the components. When the desired product has been prepared the outlet is opened and the product is discharged. When a next product has to be prepared, this process can be repeated.

However, in many cases said apparatus will be used for preparing a range of different products, each containing different components. It will be understood, that in most cases a cross-contamination between successive products has to be prevented, that means that before preparing a product in the mixing chamber said mixing chamber has to be cleaned and all residues from the previous products and previous components should be eliminated. Cleaning the mixing chamber, however, interrupts the normal operation of the apparatus, decreasing its efficiency and increasing the complexity and costs of the products and the production thereof.

In a number of environments there is a demand for an apparatus which is able of preparing successive products without the need of cleaning the mixing chamber between successive mixing operations. One of such environments, for example, are professional kitchens where there is a need for a sauce dispensing machine which can dispense portions of a variety of fresh sauces at short time intervals.

In view of the above the invention, in a first aspect thereof, provides an apparatus for mixing components for the preparation of products, such as for example foodstuffs, cosmetics and pharmaceuticals, comprising a mixing chamber which is provided with an inlet for the components and an outlet for the product, and mixing means for mixing the components after introduction thereof into the mixing chamber, characterized in that those parts of the mixing chamber which will come into contact with the components are defined by a foil material which can be renewed between two successive mixing/processing operations. This renewal of the foil is preferably such as to be able to start a mixing operation with an uncontaminated mixing chamber.

The foil material prevents the components (but also the resulting product) from coming into contact with the apparatus itself apart from the foil material. Thus, after completion of a mixing operation only the foil material has to be renewed without the need for cleaning any part of the apparatus. Of course, when two successive mixing operations relate to the preparation of one and the same product, a renewal of the foil material is not necessary, but may be carried out anyway, if desired.

In the context of the invention the term "uncontaminated" refers to being essentially free of undesired ingredients, especially those included in a previous product preparation on the same apparatus. An example is the preparation of dressings where a white base dressing is preferably uncontaminated with ketchup ingredients if the white base is prepared after a ketchup sauce.

Although in the above reference is made to "mixing", the invention also refers to other manners of processing, such as for example emulsifying, heating, cooling etc. Thus, the mixing chamber also can be used for those other manners of processing, instead of or in addition to mixing. Further, the indication "components" also includes "ingredients".

The foil can be any material and is preferably a flexible material. Examples of suitable foil material are plastics and alumina foil.

Within the general concept of the invention as stated above, a number of different embodiments of the apparatus according to the invention may be envisaged.

In a first group of embodiments the invention provides an apparatus, wherein the mixing chamber is defined between two co-operating mould parts, wherein two foil sheets are positioned between the mould parts, said mould parts being movable from an operative position in which they engage each other while clamping together the foil sheets, and an inoperative position in which they are moved apart and allow the foil sheets to be shifted relative to the mould parts.

In the operative position of the mould parts the two foil sheets are clamped therebetween, and generally will conform to the shape of the mould parts. The components to be mixed will be introduced between the two foil sheets, and thus will not come into contact with the mould parts.

It should be noted, that strictly spoken the mould parts do not engage each other, because the foil sheets are positioned therebetween. However, in the context of this specification mould parts "engaging" each other means that they are moved to a position in which the foil sheets are clamped therebetween.

Renewing the foil sheets between two successive mixing operations could be carried out by replacing the foil sheets by two new foil sheets. Although such an operation falls within the scope of the present invention, it is not preferred, because it would necessitate complicated handling means for the foil sheets. Thus, in a preferred embodiment of the apparatus according to the invention, the foil sheets are elongate foil sheets which are moved relative to the apparatus between two successive mixing operations and wherein means for moving the foil sheets are provided, such as for example reels for unwinding and/or winding the foil sheets.

Moving such elongate foil sheets is rather simple, for example using said reels. When the mould parts are moved to an inoperative position in which they do not engage each other, activating such reels automatically will lead to renewing the foil material in the vicinity of the mixing chamber.

The two foil sheets may be separate foil sheets which are clamped together in the operative position of the mould parts. In such a case separate means for moving the foil sheets are provided such as for example separate reels for unwinding and/or winding the foil sheets. However, it is also possible that the two foil sheets are one single foil member folded longitudinally onto itself. In such a case only one means for moving the foil member will be needed. However, then a folding means will be needed.

In a specific embodiment of the apparatus according to the invention one mould part is a substantially solid member having a recess in its surface facing the other mould part, while the other mould part is a flexible member which in the operative position covers the recess and sealingly engages those parts of the solid member surrounding the recess, wherein the mixing means comprise movable pressure means for pressing the flexible member into the recess such as to cause the mixing of the components present in the mixing chamber. Such an embodiment allows an easy access of the mixing means to the mixing chamber which basically is defined by the recess in the solid member.

When using such an embodiment, a clamping frame might be provided which is movable towards and away from the solid member for sealingly clamping the flexible member against the solid member, thereby also clamping together the foil sheets. When moved towards the solid member the clamping frame assures a sealing engagement between the flexible member and the solid member (again with interposition of the foil sheets). Thus a closed mixing chamber will be defined in which the mixing can occur.

Before and after the mixing operation a supply of the components and a discharge of the product, respectively, should occur. Thus, in an embodiment of the apparatus according to the invention parts of the clamping frame and/or solid member are movable independently from the remainder of the clamping frame and/or solid member for defining an inlet and/or an outlet for the mixing chamber. In an inoperative position of those parts there will be no engagement between the solid member and flexible member at the location of those parts, thus allowing a passage of the components and product, respectively.

This embodiment also allows the supply of components or ingredients during the mixing operation (or other processing operation).

For those embodiments of the invention, where the operation is a processing operation other than mixing, the chamber may be provided with only one component or ingredients composition which is subjected to the processing treatment.

Preferably, the flexible member is a reinforced member, for example a reinforced rubber sheet. When the pressure means engage the flexible member for pressing it into the recess high pressures will occur, which the flexible member should withstand.

It is noted, that one foil sheet itself could also play the role of flexible member, provided that said foil sheet is strong enough to withstand the occurring high pressures.

Further, it is possible that the flexible member is shaped as a mirror image of the recess. When the pressure means engage the flexible member, its mirror image is, in a manner of speaking, mirrored such as to obtain the shape of the recess, as a result of which a close fit between both members will be obtained. Such a close fit will promote a proper mixing of the components.

In an other preferred embodiment of the apparatus according to the invention the mixing means comprise a pressure roll movable towards the solid member for engaging the flexible member and pressing it into the recess, which pressure roll has a contour closely matching the contour of the recess, wherein further the pressure roll is movable to and for along the recess. Depending on the amount in which the pressure roll is moved towards to the solid member the mixing chamber is divided into two sections connected by a narrow passage. When, in such a position of the pressure roll, it is moved along the recess the pressure will rise in the section of the mixing chamber ahead of the roll, as a result of which the components will be pressed through the passage. In this passage shear forces will be created resulting in a mixing of the components. The principles of such a process are well known, and do not need any further explanation within the context of this invention.

For avoiding friction between the pressure roll and the flexible member, in a special embodiment of the apparatus according to the invention the pressure roll is divided into a number of concentric discs positioned alongside each other.

Although in the above embodiments of mechanical mixing means have been explained, it should be noted that also non-mechanical mixing means could be applied, such as for examples jets of pressurised air. Within the context of mechanical mixing means, it should be understood that many kinds of mechanically engaging members could be applied. However, a mixing operation in the mixing chamber could also occur when the components are introduced into the mixing chamber, for example using a syringe-like device. The mixing chamber itself than might be provided with restriction or obstruction means enhancing the mixing effect.

The apparatus according to the invention can be provided with means for cooling and/or heating the mixing chamber, for example embodied as channels provided in at least one mould part for the circulation of the cooling/heating fluid. Thus, the circumstances for preparing the product can be controlled temperature-wise.

According to a second group of embodiments of the apparatus according to the invention, the mixing chamber is defined by the foil material itself which defines a pre-shaped elongate web with a succession of separate internal cavity structures which each are provided with an inlet and an outlet for communication with the surroundings and which each are shaped such as to promote the mixing of components introduced through the inlet, and wherein the apparatus further preferably comprises a support for a cavity structure of the elongate foil material web and means for moving the elongate web relative to the support between two successive mixing operations, whereas the mixing means preferably comprise movable pressure means for engaging the cavity structure while pressing it against the support.

According to this embodiment of the apparatus according to the invention the foil material itself defines the mixing chamber, without the need of co-operating mould parts (as is the case in the previously mentioned embodiments). The mixing in the mixing chamber may occur while the components pass from the inlet towards the outlet. It is, however, also possible, that means are provided for selectively opening and closing the inlet and/or outlet of the cavity structures. Properly activating said means enable the cavity structures to be filled with the components, thereafter to be closed such as to define a closed mixing chamber in which the mixing operation occurs, and finally to be opened for discharging the prepared product. However, the mixing process also can be carried out without closing the mixing chamber with such means.

The support that co-operates with the pressure means for engaging the cavity structures may have a number of shapes. Thus, it is possible that the support has a substantially flat shape wherein the pressure means can move substantially linearly along the support. In another possible embodiment, however, the support defines part of a cylindrical inner surface wherein the pressure means can move around an axis, which is substantially concentrical with said cylindrical surface.

The pressure means for engaging the cavity structure may have many different forms, and could move in many different ways. It is to be understood, that the main objective of those pressure means is disturbing the components contained in the mixing chamber such as to promote a proper mixing. Further, these pressure means could be used to discharge the product from the mixing chamber once the mixing has been completed.

In a special embodiment, there is no support, whereas the pressure means only serve for supplying the components in the cavity structure. The mixing (processing) occurs automatically then.

With respect to these embodiments of the apparatus according to the invention, a number of additional means could be provided to enhance a proper operation of the apparatus. Thus, without being complete, the following possibilities are mentioned: means for selectively connecting the inlet to component reservoirs and for connecting the outlet to a product discharge unit; a control unit for controlling the operation of the apparatus, and an input unit for the selection of a product to be mixed which is operatively connected with the control unit.

The invention further relates to a pre-shaped elongate web of foil material for use in an apparatus for mixing components for the preparation of products, said web comprising a succession of separate internal cavity structures which each are provided with an inlet and an outlet for communication with the surroundings and which each are shaped such as to promote the mixing of components introduced through the inlet.

The invention further relates to a method for mixing components for the preparation of products, such as for example foodstuffs, cosmetics and pharmaceuticals, wherein the components are introduced into a mixing chamber which is provided with an inlet for the components and an outlet for the product, whereafter mixing means provide for a mixing of the components in the mixing chamber.

According to the present invention said method is characterised in that those parts of the mixing chamber which will come into contact with the components are defined by a foil material, wherein between two successive mixing operations the foil material is renewed such as to be able to start a following mixing operation with an uncontaminated mixing chamber. As a result of the method according to the invention differing products can be mixed successively without any cross-contamination therebetween.

In a preferred embodiment of said method, the foil material is an elongate foil material which is moved between two successive mixing operations.

Preferably, the method comprises the following steps:

after completion of a previous mixing or other processing operation opening the outlet and discharging the mixed product;

thereafter renewing the foil material and closing the outlet;

opening the inlet and introducing the components to be mixed or processed;

closing the inlet and activating the mixing means until the mixing or processing operation is completed;

repeating the above steps for each successive product to be mixed.

It should be noted, that renewing the foil material is an essential step for preventing any cross-contamination between different products. If, however, two successive mixing operations relate to the same product, renewing the foil material would not strictly be necessary.

When the method as stated above is to be carried out with an apparatus according to the first group of embodiments discussed before, the step of renewing the foil material preferably comprises firstly moving apart the mould parts followed by shifting the foil sheets relative to the mould parts and finally again moving the mould parts into engagement with each other.

When, however, the method according to the invention as stated above is to be carried out with an apparatus according to the second group of embodiments as discussed before, the step of renewing the foil material preferably comprises firstly moving the pressure means away from the support followed by shifting the elongate web relative to the support and finally again moving the pressure means towards the support.

Hereinafter the invention will be elucidated while referring to the drawings. In these drawings.

Figure 1:
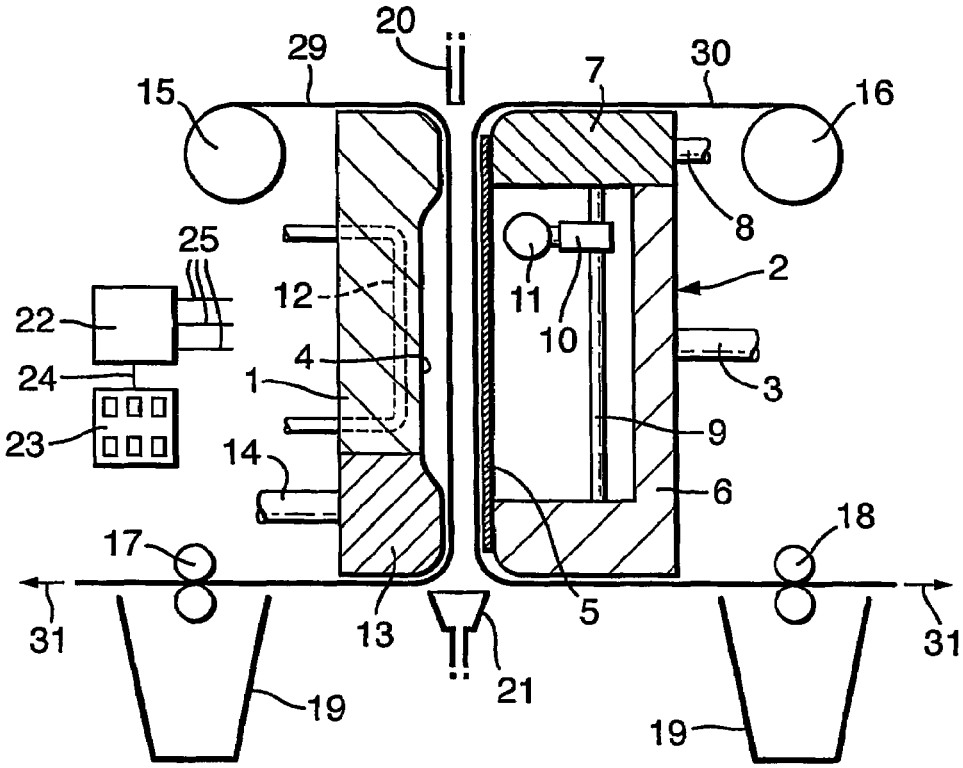
FIGS. 1-5 show an embodiment of the apparatus according to the invention in five consecutive steps while performing a mixing operation.

Before giving a detailed description of the figures, the following is noted. In FIG. 1 an embodiment of the apparatus according to the invention is shown partly in a side elevational view and partly in a longitudinal section. Only parts of the apparatus essential for understanding the invention have been illustrated. In the corresponding FIGS. 2-5 only those parts of the apparatus have been shown which are essential for understanding the respective step during the mixing operation.

FIG. 1 shows an embodiment of an apparatus for mixing components for the preparation of products, such as for example foodstuffs, cosmetics and pharmaceuticals. The apparatus comprises two co-operating mould parts 1 and 2. In the illustrated embodiment mould part 1 is stationary, whereas mould part 2 is movable towards and away from the stationary mould part 1 through a driving means 3.

Stationary mould part 1 is a substantially solid member having a recess 4 in its surface facing the movable mould part 2. Movable mould part 2 comprises a flexible member 5, for example a reinforced member such as a reinforced rubber sheet, attached to a clamping frame 6 in a manner not shown in detail. A top part 7 of the clamping fame 6 can be moved relative to the remainder of the clamping frame 6 through a driving means 8.

The mould part 2 further comprises a guide 9 for a carriage 10 supporting a pressure roll 11. The position of the pressure role 11 relative to the carriage 10 can be changed, in such a manner that the pressure roll 11 can be moved towards and away from the stationary mould part 1.

The stationary mould part 1 comprises channels 12 for the circulation of a cooling/heating fluid, said channels being connected to a source of cooling/heating fluid not shown in detail.

A lower part 13 of the stationary mould part 1 is movable relative to the remainder of the mould part 1 through a driving means 14.

Reel mechanisms 15 and 16 are provided which, in co-operation with guide rolls 17, 18 take care of guiding two foil sheets 19 and 20 between the stationary mould part 1 and the flexible member 5 of the movable mould part 2.

Below the guide rolls 17 and 18 waste material collecting reservoirs 19 are provided. At the top of the apparatus a supply unit 20 is provided, and at the bottom a discharge unit 21 can be seen.

Finally there are provided a control unit 22 for controlling the operation of the apparatus, and an input unit 23 (such as a keyboard or alike) for the selection of variables, such as a product to be mixed. A line 24 connects the input unit 23 operatively with the control unit 22, whereas output lines 25 connect the control unit 22 with several parts of the apparatus, such as the driving means 3, 8, 14 and driving means not illustrated for the reel mechanisms 15 and 16. The control unit 22 also can control other parts of the apparatus, such as the operation of the supply unit 20 as well as the supply of cooling/heating fluid through the channels 12, for example.

FIG. 1 shows the situation, in which the stationary mould part 1 and movable mould part 2 have been moved apart by the driving means 3. Also, an activation of the reel mechanisms 15 and 16 has moved the foil sheets 29 and 30 as indicated by arrows 31 such as to position fresh foil sheet parts between the mould parts 1 and 2.

Figure 2:
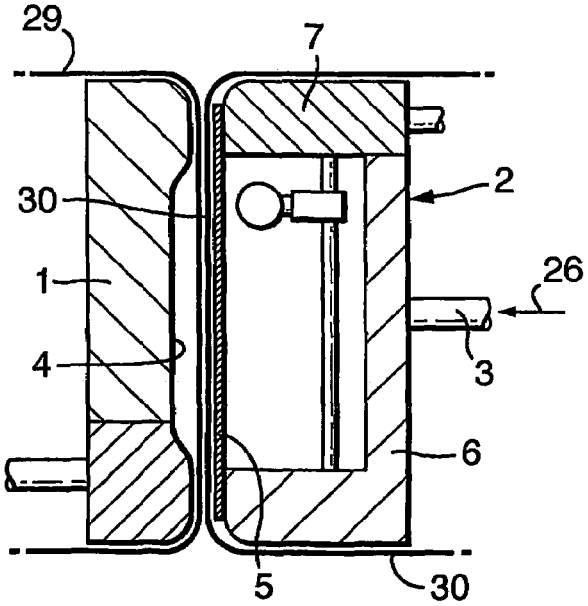

Next, referring to FIG. 2, the driving means 3 is activated such as to move the mould part 2 with flexible member 5 to the left towards stationary mould part 1 (arrow 26). As a result, the movable mould part 2 reaches a position, in which its flexible member 5 sealingly engages those parts of the mould part 1 surrounding the recess 4 (of course with interposition of both foil sheets 29 and 30). Thus, the recess 4 will define a sealed mixing chamber. During the motion of the mould part 2 the clamping frame 6 and top part 7 thereof have moved in unison. The lower part 13 of the stationary mould part 1 has not moved.

Figure 3:
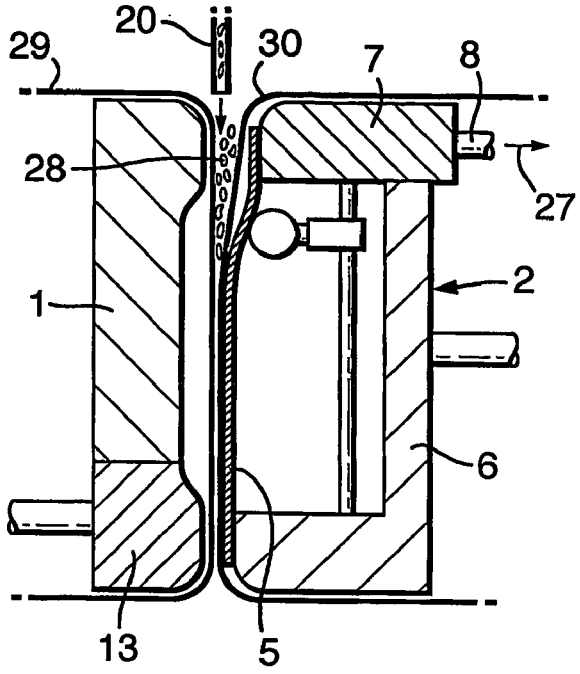

FIG. 3 shows a next step. The top part 7 of the clamping frame 6 has been moved away from the stationary mould part 1 by its driving means 8 (arrow 27). As a result the flexible member 5 and foil sheet 30 also have been moved away from the respective part of the mould part 1. In this situation an inlet for components 28 supplied by the supply unit 20 is created.

It should be noted, that, in a manner not shown in detail, the apparatus may comprise means for selectively connecting the supply unit 20 to component reservoirs not shown. In such a manner, depending on data entered at the input unit 23, appropriate components to be mixed for obtaining the desired product may be supplied.

During the supply of the components 28 the foil sheet 29 will assume a shape corresponding to the shape of the recess 4, and thus creates a mixing chamber which can be filled with the appropriate amount of components.

During this filling of components into the mixing chamber the lower part 13 of the stationary mould part 1 will continue to sealingly engage corresponding parts of the clamping frame 6 (in the figures the distance between co-operating parts of the mould parts 1 and 2 have been exaggerated).

During the steps according to FIGS. 1, 2 and 3 the position of the pressure roll 11 has not been changed.

When the appropriate amount of components has been filled into the mixing chamber defined between the mould parts 1 and 2 (inclusive the foil sheets 29 and 30 positioned therebetween) the driving means 8 is again activated to move the top part 7 of the clamping frame 6 towards the stationary mould part 1 (arrow 32). As a result, the mixing chamber becomes completely sealed. Next, pressure roll 11 is moved towards the stationary mould part 1 (arrow 33) thus pressing the flexible member 5 towards the bottom of the recess 4. This movement of the pressure roll 11 is controlled in such am manner by the control unit 22 that an appropriate gap will be created between the flexible member 5 (to be more correct the foil sheet 30 resting thereon) and the bottom of the recess 4 (to be more correct the foil sheet 29 resting thereon).

In this situation the carriage 10 is activated to move upwards and downwards along the guide 9 (arrow 34). This will result in the built-up of pressure in the mixing chamber below the pressure roll 11. Due to this built-up of pressure the components 28 will flow through the above-mentioned gap, and shear forces created will promote a proper mixing of the components.

In the bottom of the recess 4 and/or the circumference of the pressure roll 11 a channel or channels may be provided for enhancing the mixing effect.

The upward and downward motion of the pressure roll 11 can be repeated as many times as desired. During this motion of the pressure roll 11 no material can escape from the mixing chamber.

Figure 4:
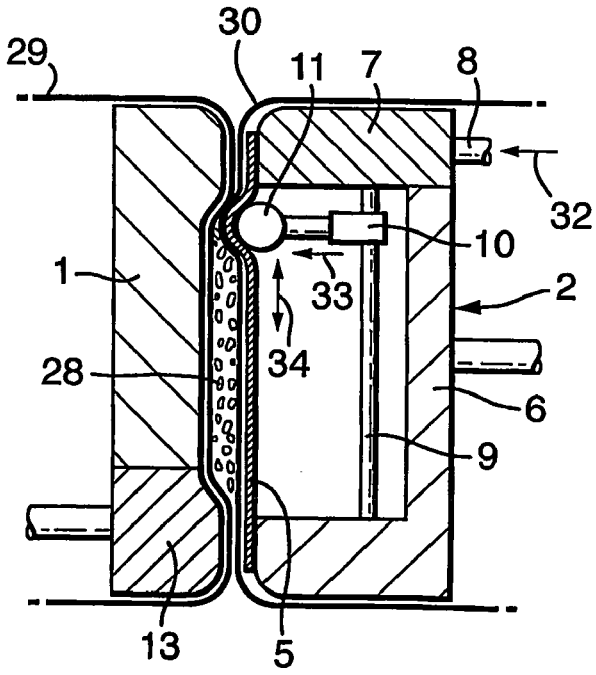
Figure 5:
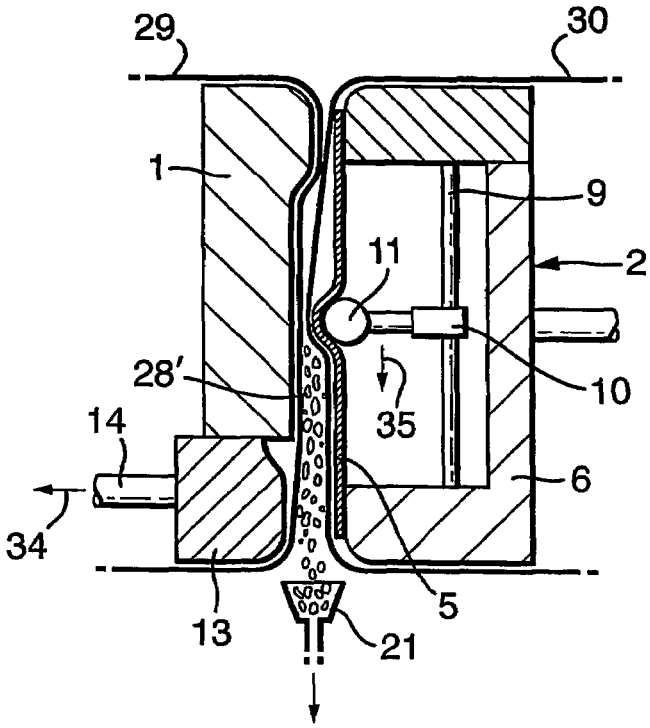

When the mixing operation has been completed, the pressure roll 11 is moved to a position as shown in FIG. 4, that is a position remote from the lower part 13 of the stationary mould part 1. Then this lower part 13 is moved towards the position as illustrated in FIG. 5 by its driving means 14 (arrow 34). The pressure roll 11 is moved further towards the stationary mould part 1 until the above-mentioned gap is completely or almost completely closed. In this situation the carriage 10 is moved downwards along the guide 9 (arrow 35) as a result of which the product 28' (obtained as a result of the performed mixing operation of the components 28) will be discharged into the discharged unit 21.

When the mixing chamber has been emptied completely in this manner, the apparatus returns to its position as illustrated in FIG. 1. The reel mechanisms 15 and 16 will be activated again to renew the foil sheets 29 and 30 in the area of the recess 4. During such a motion of the foil sheets 29 and 30 any waste material adhering to these sheets may drop into the waste material collecting reservoirs 19, aided by the co-operation between the guide rolls 17 and 18, respectively.

It should be noted that in the illustrated apparatus the foil sheets 29 and 30 comprise two elongate foil sheets. However, it is conceivable too that each foil sheet is a short length of foil material and that after having performed a mixing operation such a short length of foil material is replaced by an entirely new short length of foil material. Than there is not a continuous supply of new foil material, but an intermittent supply of separate lengths of foil material.

Moreover, in the illustrated embodiment of the apparatus the two foil sheets 29 and 30 are separate foil sheets. However, it is also possible that only one foil sheet is used which, before entering the gap between the mould parts 1 and 2 is folded longitudinally onto itself.

Instead of channels 12 for the circulation of a cooling/heating fluid also other means could be applied for changing the temperature of the components in the mixing chamber, for example a microwave device, RF heating device or IR device.

Figure 6:
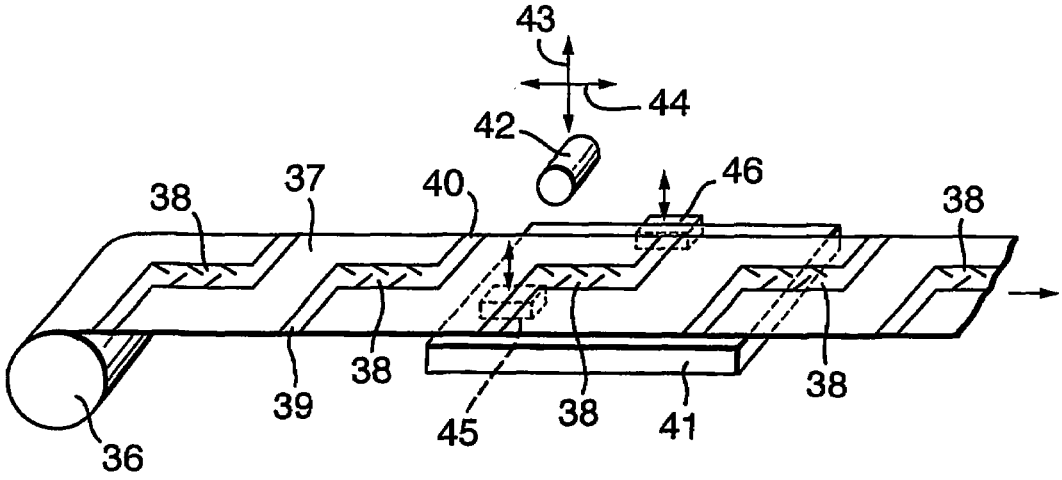
FIG. 6 shows, schematically, an alternative embodiment of the apparatus according to the invention.
Figure 10:
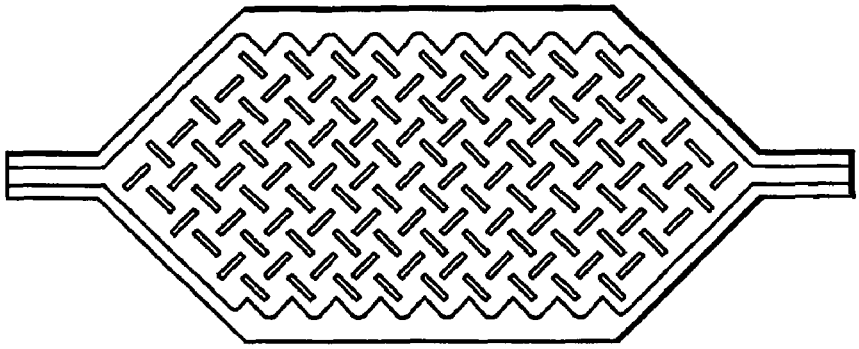
FIGS. 7-10 show examples of cavity structures of an elongate web in accordance with the invention.
Figure 9:
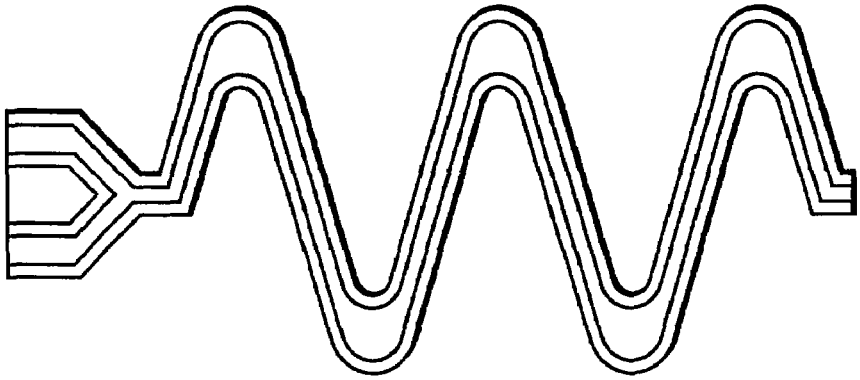
Figure 8:
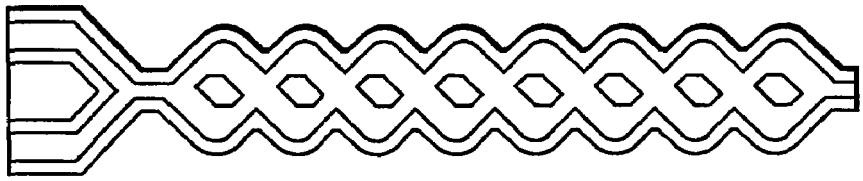
Figure 7:
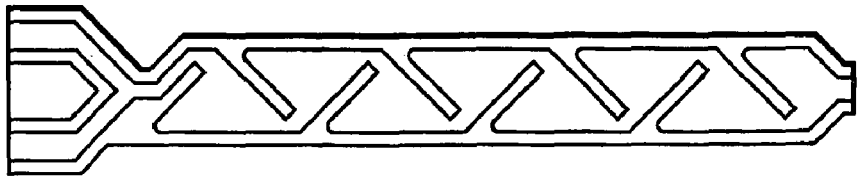

Whereas in the embodiment of the apparatus illustrated in FIGS. 1-5 the mixing chamber is basically defined by the co-operation between the mould parts 1 and 2, it is also possible that the mixing chamber is defined by the foil material itself. Such an apparatus is schematically indicated in FIG. 6. The foil material, which unwinds from a reel 36 comprises a pre-shaped elongate web 37. This web 37 is provided with a succession of separate internal cavity structures 38. Each cavity structure 38 is provided with an inlet portion 39 and outlet portion 40.

In this embodiment the apparatus further comprises a support 41 and pressure means 42 (in this specific embodiment a pressure roll) movable towards and away from the support 41 (arrow 43) and movable to and fro along the support 41 (arrow 44).

Finally, the apparatus illustrated in FIG. 6 comprises means 45 and 46 which are movable for selectively opening and closing the inlet portion 39 and outlet portion 40, respectively, of the cavity structures 38.

The apparatus illustrated in FIG. 6 operates in the following manner. The reel 36 unwinds the web 37 until a cavity structure 38 is positioned at the support 41. The means 46 is moved into contact with the web 37 closing the outlet portion 40 of the cavity structure 38. Means 45 is moved upwards such as to open the inlet portion 39 of the cavity structure 38, and in a way not shown in detail components to be mixed are introduced into the cavity structure 38. Next, means 45 is moved into contact again with the web 37 closing the inlet portion 39. Thereafter the pressure means 42 is moved into contact with the web 37 until an appropriate gap remains between this pressure means 42 and support 41. Then the pressure means 42 is moved along the support 41 (arrow 44) as a result of which the components contained in the cavity structures 38 are pressed through the gap and a mixing occurs.

When the mixing operation has been completed, the means 46 is lifted again and the product is discharged from the cavity structure 38 (for example by means of the pressure means 42 in a manner as described before in connection with the embodiment illustrated in FIGS. 1-5).

Next, means 45 and 46 and pressure means 42 disengage the web 37 which then is shifted in such a manner that a new successive cavity structure 38 is positioned at the support 41, after which a next mixing operation can occur. The cavity structures 38 can have different shapes, promoting the mixing of the components. FIGS. 7-10 show examples of such cavity structures.

The invention is not limited to the embodiments described before, which may be varied widely within the scope of the invention as defined by the appending claims.

The invention claimed is:

1. Apparatus for mixing components for the preparation of products, such as for example foodstuffs, cosmetics and pharmaceuticals, comprising a mixing chamber which is provided with an inlet for the components and an outlet for the product, wherein the mixing chamber is defined between two co-operating mould parts, wherein two foil sheets are positioned between the mould parts, said mould parts being movable from an operative position in which they engage each other while clamping together the foil sheets, and an inoperative position in which they are moved apart and allow the foil sheets to be shifted relative to the mould parts; and mixing means for mixing the components after introduction thereof into the mixing chamber, characterized in that the foil material prevents the components and resulting product from coming into contact with the apparatus itself apart from the foil material and wherein the foil sheets are elongate foil sheets which are moved relative to the apparatus between two successive mixing operations and wherein means for moving the foil sheets are provided.

2. Apparatus according to claim 1, wherein one mould part is a substantially solid member having a recess in its surface facing the other mould part, while the other mould part is a flexible member which in the operative position covers and seals the recess, wherein the mixing means comprise movable pressure means for pressing the flexible member into the recess such as to cause the mixing of the components present in the mixing chamber.

3. Apparatus according to claim 2, wherein the mixing means comprise a pressure roll movable towards the solid member for engaging the flexible member and pressing it into the recess, which pressure roll has a contour closely matching the contour of the recess, wherein further the pressure roll is movable to and fro along the recess.

4. Apparatus according to claim 1, wherein the mixing chamber is defined by the foil material itself which defines a pre-shaped elongate web with a succession of separate internal cavity structures which each are provided with an inlet and an outlet for communication with the surroundings and which each are shaped such as to promote the mixing of components introduced through the inlet, and wherein the apparatus further preferably comprises a support for a cavity structure of the elongate foil material web and means for moving the elongate web relative to the support between two successive mixing operations, whereas the mixing means preferably comprise movable pressure means for engaging the cavity structure while pressing it against the support.

5. Method for mixing components for the preparation of products, such as for example foodstuffs, cosmetics and pharmaceuticals in an apparatus, wherein the components are introduced into a mixing chamber which is provided with an inlet for the components and an outlet for the product said mixing chamber defined between two co-operating mould parts, wherein two foil sheets are positioned between the mould parts, said mould parts being movable from an operative position in which they engage each other while clamping together the foil sheets, and an inoperative position in which they are moved apart and allow the foil sheets to be shifted relative to the mould parts; whereafter mixing means provide for a mixing of the components in the mixing chamber, characterized in that a foil material prevents the components and resulting product from coming into contact with the apparatus itself apart from the foil material, wherein between two successive mixing operations the foil material is renewed to start a following mixing operation with an uncontaminated apparatus; wherein the method comprises the following steps:

after completion of a previous mixing or other processing operation opening the outlet and discharging the mixed/processed product;

thereafter renewing the foil material and closing the outlet;

opening the inlet and introducing the components to be mixed or processed;

closing the inlet and activating the mixing means until the mixing or processing operation is completed;

repeating the above steps for each successive product to be mixed.

6. Method according to claim 5, wherein the mixing chamber is defined by the foil material itself which defines a pre-shaped elongate web with a succession of separate internal cavity structures which each are provided with an inlet and an outlet for communication with the surroundings and which each are shaped such as to promote the mixing of components introduced through the inlet, and a support for the cavity structure of the elongate material web and means for moving the elongate web relative to the support between two successive mixing operations are provided, whereas the mixing means comprise movable pressure means for engaging the cavity structure while pressing it against the support; and wherein the step of renewing the foil material comprises firstly moving the pressure means away from the support followed by shifting the elongate web relative to the support and finally again moving the pressure means towards the support.

* * * * *